US005669171A

United States Patent [19]

Sally

[11] Patent Number: 5,669,171

[45] Date of Patent: Sep. 23, 1997

[54] SPEEDLOADER FOR MAGAZINES OF AUTOMATIC RIFLES

[76] Inventor: Thomas A. Sally, 2344 N. Old Bethlehem Pike, Quakertown, Pa. 18951

[21] Appl. No.: 718,066

[22] Filed: Sep. 17, 1996

[51] Int. Cl.[6] ..... F41A 9/61; F41A 9/82

[52] U.S. Cl. ..... 42/87; 42/60

[58] Field of Search ..... 42/87, 60

[56] References Cited

U.S. PATENT DOCUMENTS

| | | | |
|---|---|---|---|
| 3,710,497 | 1/1973 | Musgrave | 42/87 |
| 4,152,857 | 5/1979 | Ketterer | 42/88 |
| 4,304,062 | 12/1981 | Pepe et al. | 42/87 |
| 4,570,371 | 2/1986 | Mears | 42/90 |
| 4,706,402 | 11/1987 | Csongor | 42/87 |
| 4,756,110 | 7/1988 | Beltron | 42/87 |

*Primary Examiner*—Charles T. Jordan
*Assistant Examiner*—Meena Chelliah
*Attorney, Agent, or Firm*—William Freedman

[57] ABSTRACT

This speedloader, which is usable to facilitate the loading of bullets into the magazine of an automatic rifle, comprises a casing that has a passage extending therethrough from its top to its bottom, the passage having an open top through which bullets may be fed and an open bottom into which the top of the magazine may be inserted. The speedloader also comprises means for fastening the magazine to the casing in a position within the passage that allows bullets to be fed through the top of the passage into the magazine. Atop the casing is an adapter for releasably attaching to the casing a stripper clip holding bullets. Means is provided for fastening the casing to the belt of a rifle-user so that the casing remains fixed to the belt, and hence to the waist of the rifle-user, as bullets are pushed downwardly off the stripper clip into the magazine.

9 Claims, 6 Drawing Sheets

Fig. 1a
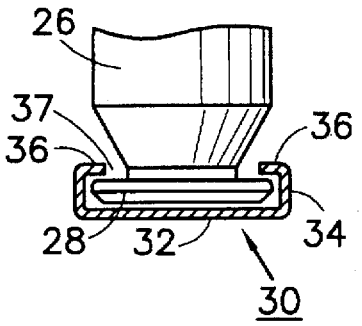
Fig. 1c
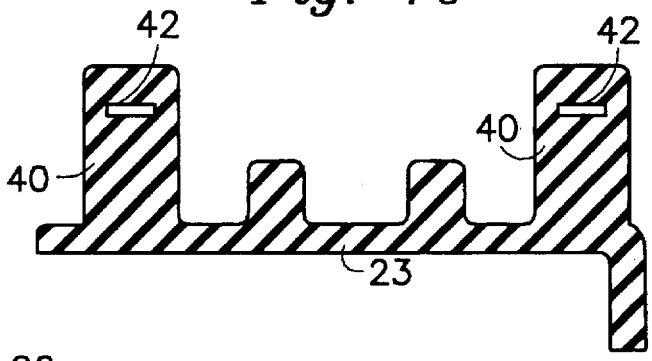
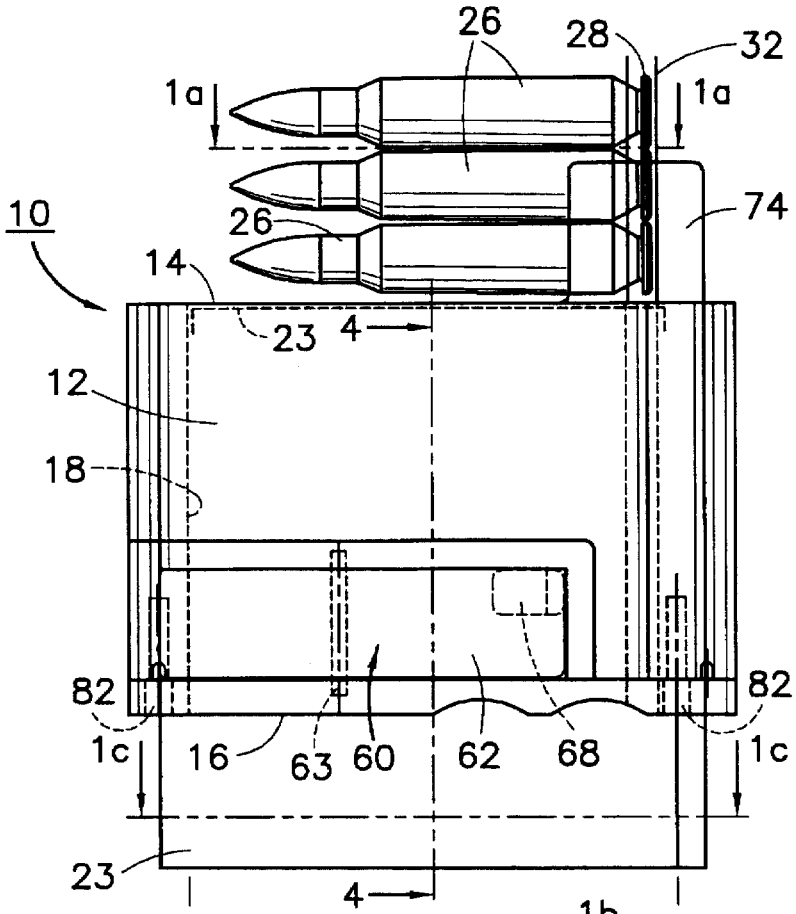
Fig. 1
Fig. 1b
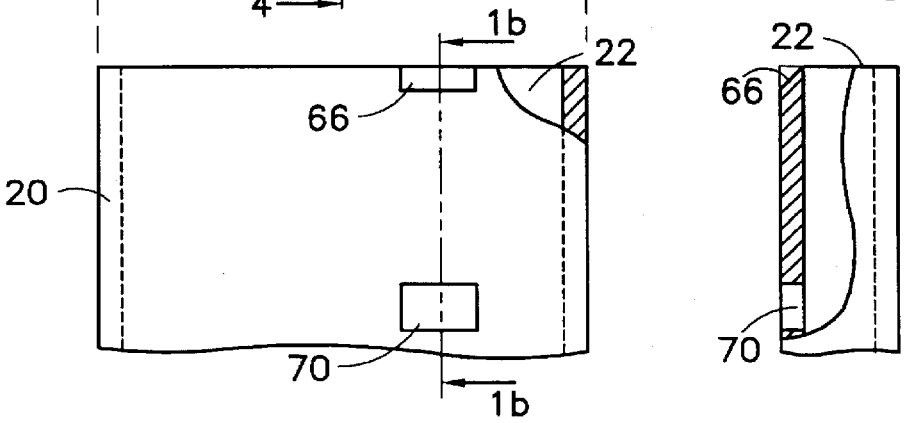

SPEEDLOADER FOR MAGAZINES OF AUTOMATIC RIFLES

FIELD OF INVENTION

This invention relates to a device, hereinafter called a speedloader, that can be used to facilitate the loading of bullets into the magazine of an automatic rifle. The invention also relates to a method of using the speedloader to perform such loading.

BACKGROUND

The typical automatic rifle includes a magazine containing bullets that are automatically fed into the barrel of the rifle as the rifle is fired. The magazine, when empty, can be manually released from the rifle and quickly replaced by a loaded magazine to permit continued firing of the rifle. This procedure can be repeated one or more times, but eventually the empty magazines need to be reloaded with bullets to permit their continued use.

One prior method for reloading the magazines has involved the use of a device called a "spoon". The spoon is a metal guide, normally separate from the magazine, that is attached to the top of the magazine to facilitate loading of the bullets into the magazine. The bullets to be loaded are normally carried by the rifle-user, typically a soldier, in stripper clips stored in a bandolier. Each stripper clip is a strip on which a plurality of bullets are slidably mounted. To effect reloading of the magazine, the soldier removes a loaded stripper clip from his bandolier, inserts it into the spoon that he has already mounted on the top of the magazine, and pushes the bullets on the stripper clip into the magazine, assisted by the guidance provided by the spoon. This is a time-consuming operation for the soldier since he must first locate the spoon, attach it to the top of the magazine, and then use the stripper clip to reload the magazine. A still greater disadvantage of this prior procedure is that it requires two hands to carry out, forcing the soldier to lay his rifle down to free his hands for the reloading procedure, thus leaving him defenseless and immobile while reloading his magazine(s). There is also the possibility that while engaged in battle, the soldier may drop and lose the spoon since it is small and easily misplaced, thus making it very difficult to use the stripper clip to reload the empty magazine.

Another prior method for reloading involves the use of a speedloader that has the spoon built into it. This speedloader is a casing that has a passage extending between its top and bottom and the built-in spoon extending along one edge of the passage. The speedloader is placed atop the magazine, a loaded stripper clip is placed in the passage, and bullets are pushed by the soldier down the passage into the magazine. While the use of such a speedloader eliminates some of the disadvantages associated with the separate spoon, it is still subject to the significant disadvantage that it requires both hands of the soldier to effect reloading of the magazine. He must hold the magazine in one hand and, while doing this, push the bullets from the stripper clip through the speedloader into the magazine with his other hand. As above pointed out, this is highly disadvantageous since the soldier is left defenseless and immobile while reloading with both hands.

OBJECTS

An object of my invention is to provide a speedloader that enables a user to reload an automatic-rifle magazine by a method that requires only one hand to perform.

Another object is to provide a speedloader that is simple in construction and does not contain small parts that require separation from the speedloader and are easily lost.

Another object is to provide a method of using a speedloader to reload automatic-rifle magazines that can be practiced by a rifle-user with only one hand.

SUMMARY

In carrying out the invention in one form, I provide a speedloader that is usable to facilitate the loading of bullets into the magazine of an automatic rifle. The speedloader comprises a casing that has a passage extending therethrough from its top to its bottom, the passage having an open top through which bullets may be fed and an open bottom into which the top of the magazine may be inserted. The speedloader also comprises means for fastening the magazine to the casing in a position within the passage that allows bullets to be fed through the top of the passage into the magazine. Atop the casing is an adapter for releasably attaching to the casing a stripper clip holding bullets. Means is provided for fastening the casing to the belt of a rifle-user so that the casing remains fixed to the belt, and hence to the waist of the rifle-user, as bullets are pushed downwardly off the attached stripper clip into the magazine.

BRIEF DESCRIPTION OF FIGURES

FIG. 1 is a front elevational view of a speedloader embodying one form of my invention. Also illustrated in FIG. 1 is a magazine shown below the speedloader and a stripper clip loaded with bullets shown above the speedloader.

FIG. 1*a* is an enlarged sectional view taken along the line 1*a*—1*a* of FIG. 1.

FIG. 1*b* is a partial sectional view of the magazine of FIG. 1 taken along the line 1*b*—1*b* of FIG. 1.

FIG. 1*c* is a sectional view taken along the line 1*c*—1*c* of FIG. 1.

DETAILED DESCRIPTION OF EMBODIMENT

Figure 2:
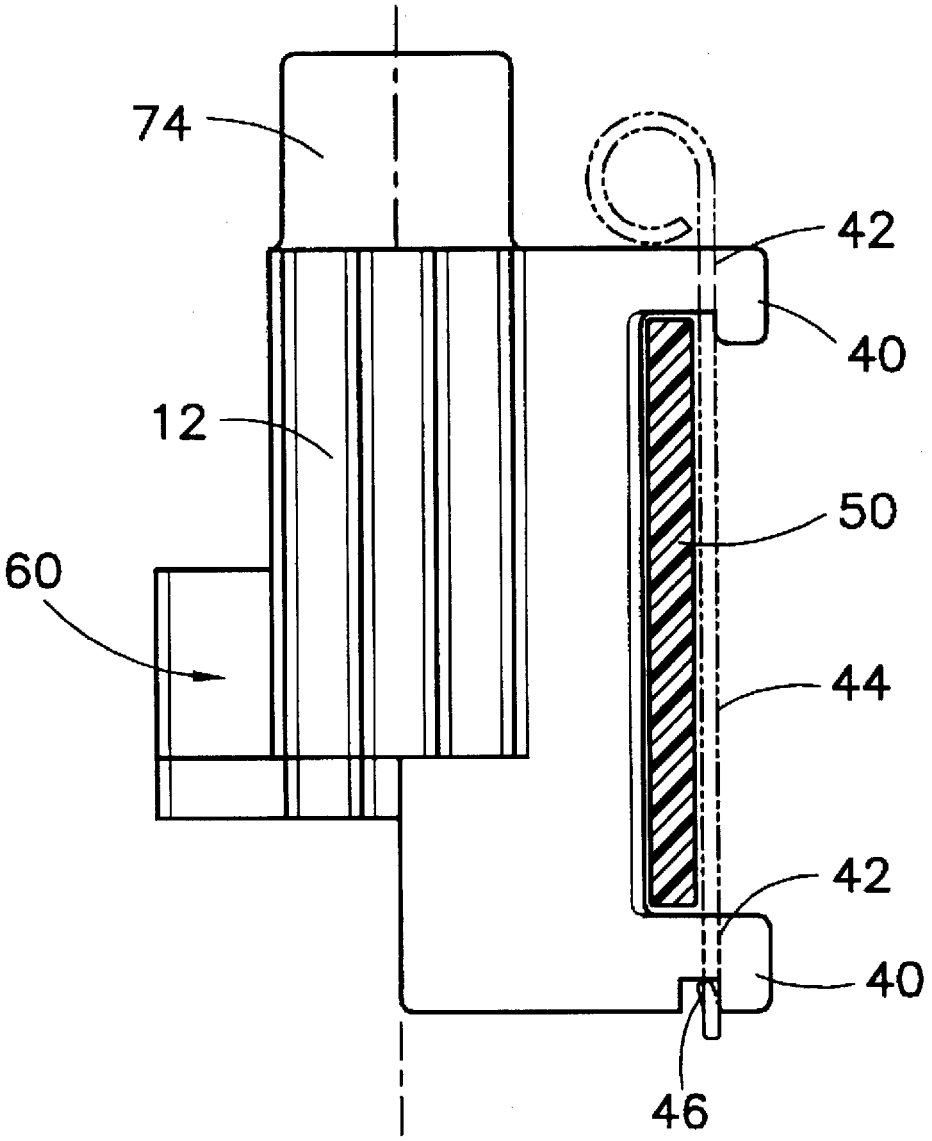
FIG. 2 is a right-side elevational view of the speedloader of FIG. 1 showing the speedloader attached to the belt of a rifle user.

Referring first to FIG. 1, the illustrated speedloader 10 comprises a casing 12 having a top surface 14 and a bottom surface 16. A passage 18, open at both its top and bottom ends, extends between the top and the bottom surfaces of the casing 12. The magazine 20 that is to be loaded with bullets is shown in solid lines in a location beneath the speedloader. This magazine has an opening 22 at its top through which bullets are inserted to load the magazine. Projecting downwardly from the casing 12 is a guide member 23 of U-shaped cross-section that is used for guiding the magazine 20 into the passage 18 when the magazine is moved upwardly into the passage 18 in preparation for a bullet-loading operation, soon to be described.

The bullets to be loaded are shown at 26 in FIG. 1. Each bullet, which is of a conventional form, includes at its right-hand end a radially-projecting shoulder 28. the bullets are carried by a conventional stripper clip 30 of generally U-shaped cross-section in which the shoulders 28 are seated. The U-shaped stripper clip 30 comprises a base 32 and two arms 34 at opposite edges of the base. These arms 34 terminate in lips 36 that are spaced from each other to provide a vertically-extending slot 37 through which the bullets project. The shoulders 28 on the bullets are retained on the stripper clip by these lips 36. When it is desired to load the bullets into the magazine, the bullets are pushed downwardly along the stripper clip, forcing them to slide downwardly in the slot 37 in the stripper clip and then off the lower end of the stripper clip, as will soon be explained in more detail.

Figure 3:
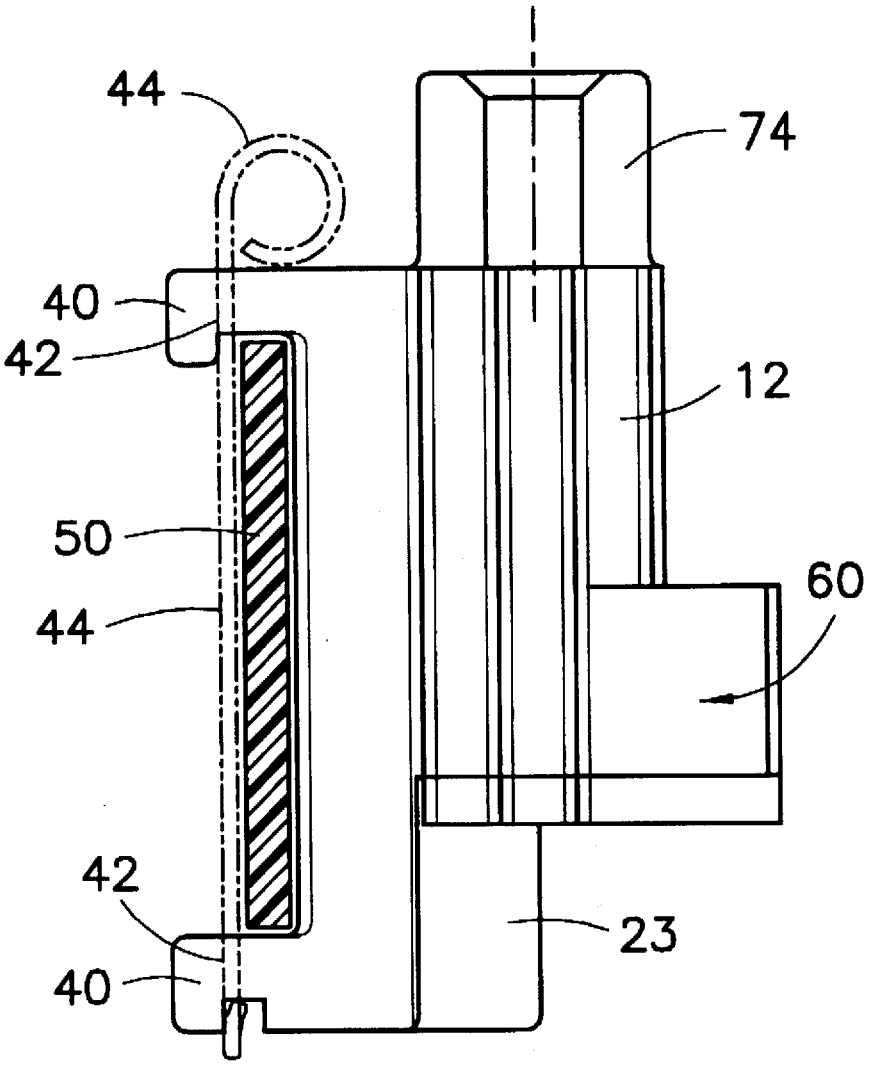
FIG. 3 is a left-side elevational view of the speedloader of FIG. 1 showing the speedloader attached to the belt of the rifle user.

The casing 12 of the speedloader includes means for fastening it to the belt of a rifle-user, typically a soldier. Referring to FIGS. 2 and 3, this fastening means comprises two horizontally-spaced pairs of vertically-spaced bosses 40 on the inside face of the speedloader 10. The upper boss 40 of each pair is located on one face of the casing 12, and the lower boss 40 of each pair is located on one face of the guide member 23. Each boss 40 contains a hole 42 extending vertically therethrough. The holes 42 in each pair of vertically-spaced bosses are aligned so that an elongated clip 44 can be passed through the aligned holes, as is best shown in FIG. 2. Each clip 44 has a spring-loaded detent 46 on its lower end that prevents upward movement of the clip unless the detent is compressed.

The belt of the soldier who is carrying the speedloader is shown at 50 in a position between the vertically-spaced bosses 40. The belt is also positioned between the clips 44 and the inner face of the speedloader, thus firmly anchoring the speedloader 10 to the belt and hence to the waist of the soldier.

Figure 4:
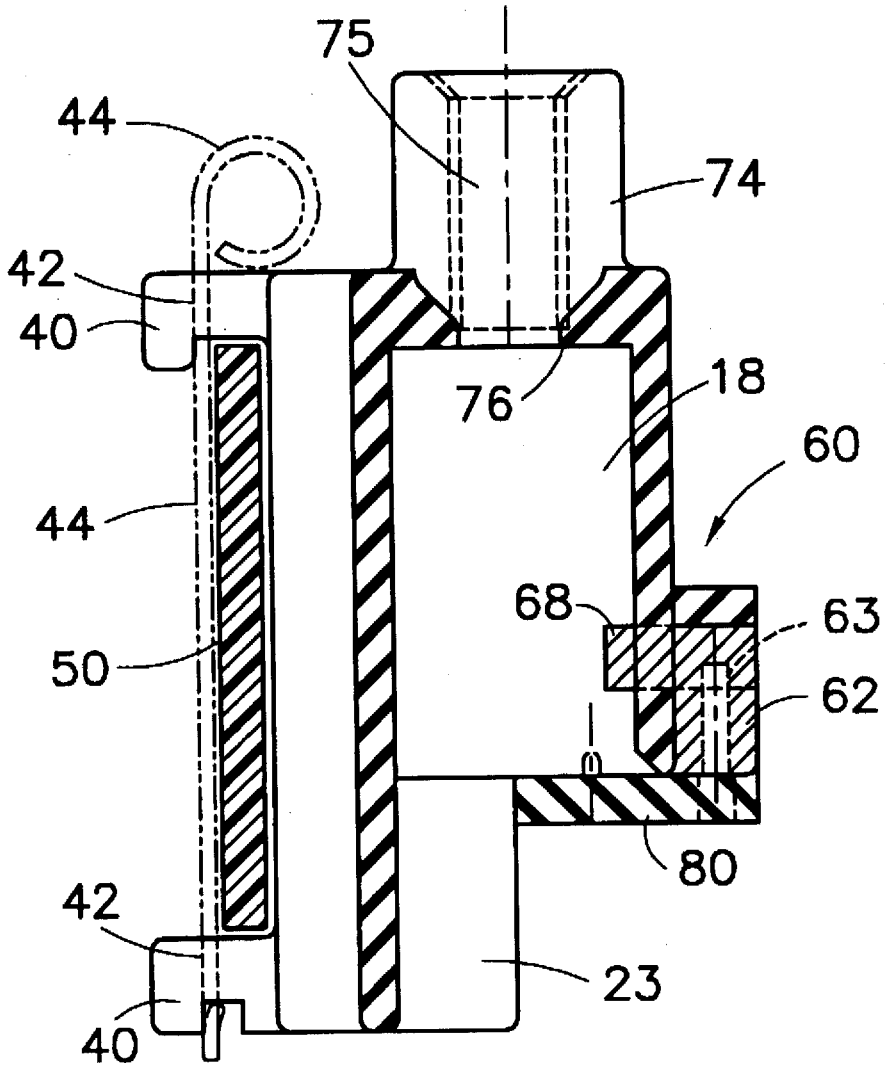
FIG. 4 is a sectional view taken along the line 4—4 of FIG. 1. The stripper clip and bullets are omitted from the showing of FIG. 4.
Figure 5:
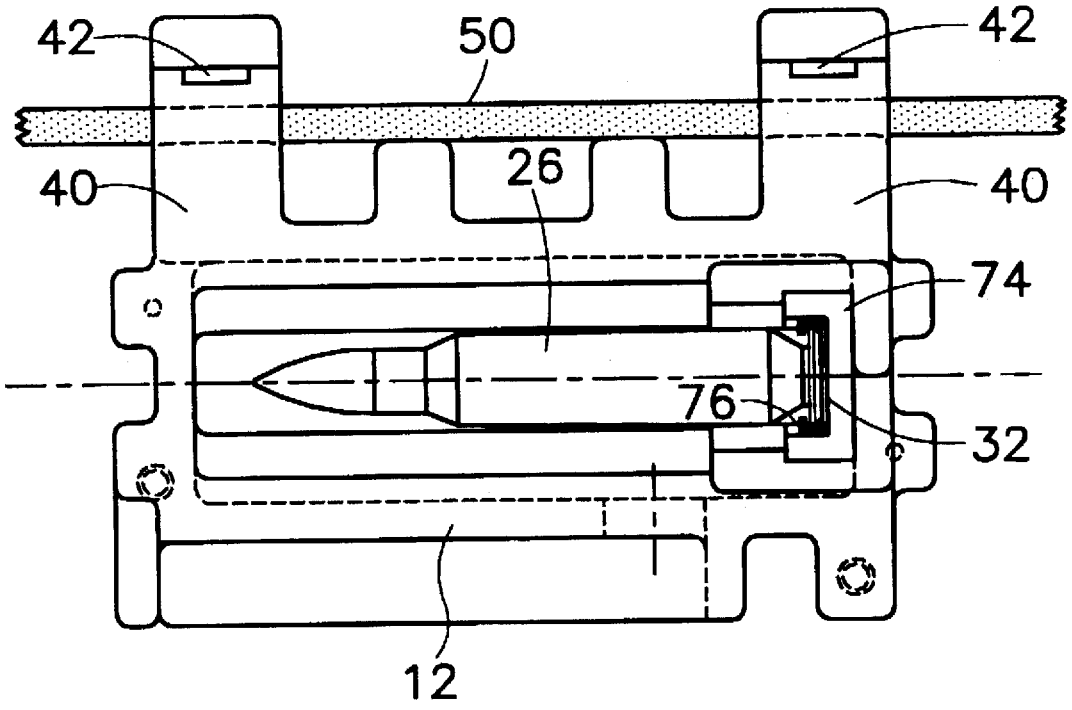
FIG. 5 is a top plan view of the speedloader showing a stripper clip loaded with bullets inserted into the speedloader.

When the soldier wishes to reload an empty magazine, such as the magazine 20 of FIG. 1, he grasps the magazine in one hand and pushes it upwardly so that its upper end enters passage 18 of the speedloader casing. The speedloader casing 12 is held fixed during this interval since it is fixed to the soldier's belt, as above noted. When the magazine has been pushed upwardly into the speedloader casing by a sufficient distance (where its top is shown by the dotted line 24 of FIG. 1), it is latched in place by a releasable latch carried on the casing 12. This latch, which is shown at 60 in FIGS. 1, 4 and 6, includes a latching member 62 pivotally mounted by a pivot pin 63 on the casing 12 and spring means 64 biasing the latching member about the axis of pivot pin 63 toward a latching position. A projection 68 on the end of the latching member 62 is adapted to cooperate with a hole 70 in one wall of the magazine to effect latching together of the magazine 20 and the casing 12 when the hole 70 is moved into alignment with the projection 68. A cam surface 66 on the magazine in a location above the hole 70 and near the top of the magazine forces the latching member 62 out of its latching position against the bias of spring 64 when the magazine first enters the passage 18, but when the magazine has been moved upwardly sufficiently, the projection 68 on the latching member is forced by spring 64 into the hole 70 thereby completing a latching operation. Referring to FIG. 1, when the soldier wishes to remove the magazine 20 from the casing 12 of the speedloader, he depresses the left hand end of the latching member with the thumb of the same hand used for positioning the magazine. This releases the latch and permits the soldier to move the magazine downwardly out of the casing 12, which he can do with the same hand that was used for depressing the latching member. As soon as the magazine is moved a short distance downwardly to move the hole 70 out of alignment with projection 68, the latching member can be released without causing any interference with downward movement of the magazine. Release of the latch and downward movement of the magazine can easily be effected by the soldier using only one hand.

For loading bullets into the magazine 20 via the speedloader 10, the soldier takes a loaded stripper clip 30 from his bandolier and inserts the lower end of the stripper clip into an adapter 74 of U-shaped horizontal cross-section located at the top of casing 12 and integral with casing 12. The adapter 74 contains a vertically-extending channel-shaped passage 75 that receives the lower end of the stripper clip and includes a stop 76 at the bottom of passage 75 that the bottom surface of the stripper clip abuts against when the stripper clip is fully inserted into the adapter.

After the loaded stripper clip has been inserted into the adapter 74, the transfer of bullets from the stripper clip to the magazine 20 is effected by manually pushing the bullets downwardly off of the stripper clip into the open top of the magazine. This downward pushing of the bullets can be carried out by the soldier by using the same hand that he had used for fastening the magazine to speedloader casing 12. The soldier can simply press downwardly with the thumb of this same hand against the top bullet in the stripper clip, and this forces the bullets in the stripper clip to slide downwardly along the stripper clip into the attached magazine 20 through the open top of the magazine.

Figure 6:
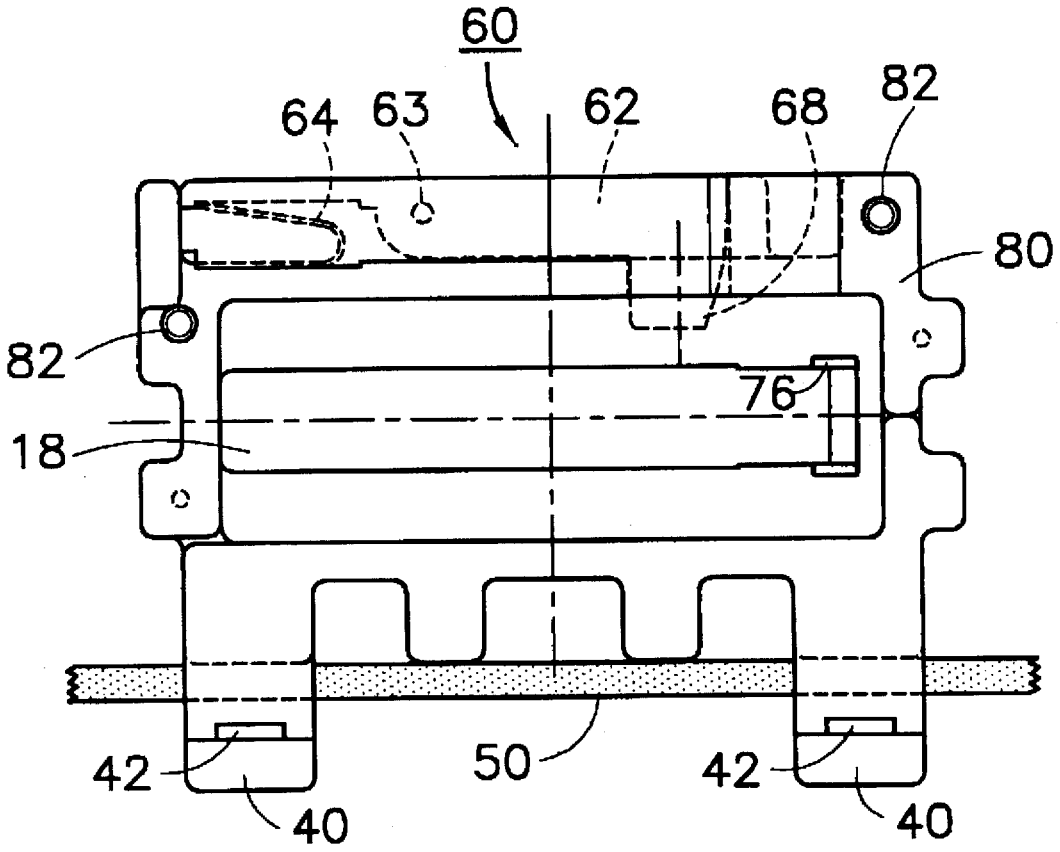
FIG. 6 is a bottom plan view of the speedloader.

More details of the latch 60 are shown in the bottom plan view of FIG. 6. As shown in this figure, a plate 80 is attached by screws 82 to the bottom surface of the body of casing 12. The lower end of the pivot pin 63 on which the latching member 62 is mounted is rotatable mounted in a hole in the plate 80. The spring 64 is a hairpin-shaped spring which has one arm bearing against the latching member 62 and its other arm bearing against the body of casing 12. The resilience of the spring biases the arms apart and urges the latching member 62 in a clockwise direction as viewed in FIG. 6.

It will be apparent from the above detailed description that a soldier using only one of his hands can easily attach the magazine 20 to the speedloader casing 12 on his belt and can also easily fasten the loaded stripper clip 30 to the speedloader casing with the same hand and can then, using the same hand, push bullets downwardly from the stripper clip through the top of passage 18 into the magazine 20. After the magazine 20 is thus loaded, the soldier can easily release the loaded magazine from the speedloader casing by depressing the latching member 62 and at the same time pulling the magazine downwardly to release it from the speedloader casing 12. Since the latching member 62 and the magazine are close together and can be readily operated with simple motions to effect release, it is a simple matter to effect release of the magazine using one hand. The stripper clip 30 can easily be released from the speedloader casing 12 simply by pulling it upwardly from its position of FIG. 1 with the same hand used for the other operations. By avoiding the need for using both hands for the reloading operation, the soldier is free to use his other hand to continue firing his automatic rifle while reloading, thus greatly improving his protection and capabilities.

While I have shown and described a particular embodiment of my invention, it will be apparent to those skilled in the art that various changes and modifications can be made without departing from the invention in its broader aspects; and I, therefore, intend herein to cover all such changes and modifications as fall within the true spirit and scope of the invention.

What I claim as new is:

1. A speedloader that is usable to facilitate the loading of bullets into the magazine of an automatic rifle by a rifle-user using only a single hand for the loading operation, comprising:

(a) a casing having a passage extending therethrough from its top to its bottom, the passage having an open top through which bullets may be fed and an open bottom into which the top of the magazine may be inserted, (b) means for fastening the magazine to said casing in a position within said passage that allows bullets to be fed through the top of said passage into the magazine, (c) means atop said casing for releasably attaching to said casing a stripper clip holding bullets, and (d) means for fastening said casing to the belt of a rifle user so that the casing remains fixed to the belt as bullets are pushed downwardly off the stripper clip into the magazine while the magazine is fastened to the casing in the position defined in paragraph (b) hereinabove.

2. A speedloader that is usable to facilitate the loading of bullets into the magazine of an automatic rifle, comprising:

(a) a casing having a passage extending therethrough from its top to its bottom, the passage having an open top through which bullets may be fed and an open bottom into which the top of the magazine may be inserted, (b) means for fastening the magazine to said casing in a position within said passage that allows bullets to be fed through the top of said passage into the magazine, (c) means atop said casing for releasably attaching to said casing a stripper clip holding bullets, and (d) means for fastening said casing to the belt of a rifle user so that the casing remains fixed to the belt as bullets are pushed downwardly off the stripper clip into the magazine, and (e) in which the means for fastening the casing to the magazine comprises a latch including a movable latching member mounted on said casing and manually operable by the rifle user.

3. The speedloader of claim 2 in which the latch is so close to an exposed portion of a magazine fastened to said casing that concurrently the latch can be released and the magazine detached by a rifle-user using only one hand.

4. The speedloader of claim 3 in which the latching member is located near the bottom of said casing.

5. A method of reloading a magazine of an automatic rifle by a rifle-user, comprising:

(a) providing a speedloader casing that is fastened to the belt of the rifle-user, the casing having a passage extending therethrough from its top to its bottom, the passage having an open top through which bullets may be fed and an open bottom into which the top of the magazine may be inserted, (b) fastening the magazine to said casing in a position to allow bullets to be fed through the top of said passage into the magazine, (c) releasably attaching to the top of the casing a stripper clip loaded with bullets.

(d) pushing bullets downwardly off of the stripper clip through the top of said passage into the top of the magazine while the speedloader casing is fastened to said belt and while the magazine is fastened to said speedloader casing in the position defined in paragraph (b) hereinabove, and (e) using a single hand for carrying out the steps defined in paragraphs (b), (c), and (d).

6. The method of claim 5 in which the magazine and the stripper clip are detached from the speedloader casing after a magazine-loading operation using the same hand as used for carrying out the steps defined in paragraphs (b), (c), and (d) of claim 5.

7. A speedloader that is usable to facilitate the loading of bullets into the magazine of an automatic rifle, comprising:

(a) a casing having a passage extending therethrough from its top to its bottom, the passage having an open top through which bullets may be fed and an open bottom into which the top of the magazine may be inserted, (b) means for fastening the magazine to said casing in a position within said passage that allows bullets to be fed through the top of said passage into the magazine.

(c) means atop said casing for releasably attaching to said casing a stripper clip holding bullets, and (d) means for fastening said casing to the belt of a rifle user so that the casing remains fixed to the belt as bullets are pushed downwardly off the stripper clip into the magazine, and (e) in which said means for fastening the magazine to the casing comprises a latching member mounted on said casing, spring means biasing said latching member in a direction to latch the casing to said magazine, and manually-operable means on said latching member through which force can be applied to release said latching member from its latching relationship with the magazine.

8. The speedloader of claim 7 in which said manually operable means is located near the bottom of said casing.

9. A method of reloading a magazine of an automatic rifle by a rifle-user, which method allows the steps of the following paragraphs (b), (c), and (d) to be practiced by the rifle-user with a single hand, comprising:

(a) providing a speedloader casing that is fastened to the belt of the rifle-user, the casing having a passage extending therethrough from its top to its bottom, the passage having an open top through which bullets may be fed and an open bottom into which the top of the magazine may be inserted, (b) fastening the magazine to said casing in a position to allow bullets to be fed through the top of said passage into the magazine, (c) releasably attaching to the top of the casing a stripper clip loaded with bullets, and (d) pushing bullets downwardly off of the stripper clip through the top of said passage into the top of the magazine while the speedloader casing is fastened to said belt and while the magazine is fastened to the speedloader casing in the position defined in paragraph (b) hereinabove.

* * * * *